US008522708B2

(12) United States Patent
Chon

(10) Patent No.: US 8,522,708 B2
(45) Date of Patent: Sep. 3, 2013

(54) INFLATABLE BOAT HAVING SELF-INFLATION SYSTEM

(75) Inventor: Dong-Gyu Chon, Seoul (KR)

(73) Assignee: Bay Industrial Co., Ltd., Seoul (KR)

( * ) Notice: Subject to any disclaimer, the term of this patent is extended or adjusted under 35 U.S.C. 154(b) by 231 days.

(21) Appl. No.: 13/109,097

(22) Filed: May 17, 2011

(65) Prior Publication Data

US 2012/0227658 A1 Sep. 13, 2012

(30) Foreign Application Priority Data

Mar. 9, 2011 (KR) ..... 10-2011-0021025

(51) Int. Cl.
*B63B 7/00* (2006.01)

(52) U.S. Cl.
USPC ..... 114/345

(58) Field of Classification Search
USPC ..... 114/61.25, 345
See application file for complete search history.

(56) References Cited

U.S. PATENT DOCUMENTS 1,372,528 A * 3/1921 Marcovsky ..... 114/347
2,370,069 A * 2/1945 Patten ..... 114/345
4,873,933 A * 10/1989 Bennett et al. ..... 441/36
5,597,335 A * 1/1997 Woodland ..... 441/36

* cited by examiner

*Primary Examiner* — Daniel Venne
(74) *Attorney, Agent, or Firm* — MKG, LLC

(57) ABSTRACT

Disclosed is an inflatable boat having a self-inflation system which advantageously makes it possible to shorten the air injection time, thus quickly taking a proper measure under an emergency situation, in such a manner that a speed tube or an air passage tube disposed in the boat's body and an air distribution system each help inject compressed air into a plurality of compartments forming the boat's body simultaneously at a designated pressure.

7 Claims, 7 Drawing Sheets

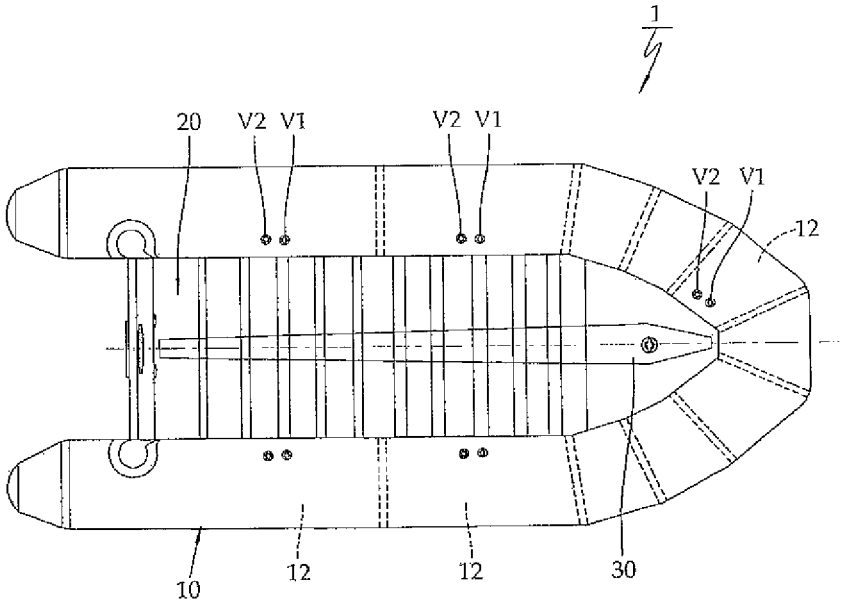
FIG. 1(a) ---PRIOR ART---
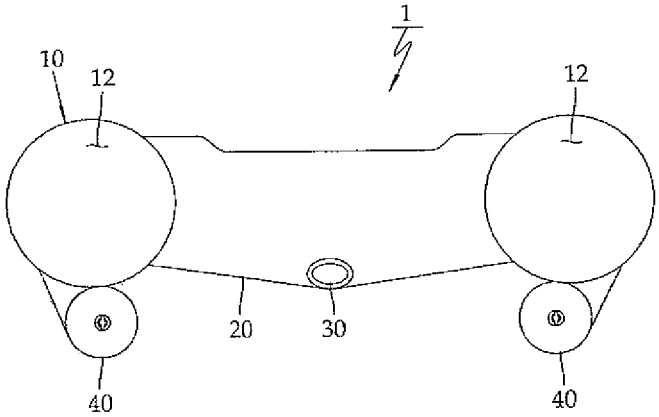
FIG. 1(b) ---PRIOR ART---

Fig. 4
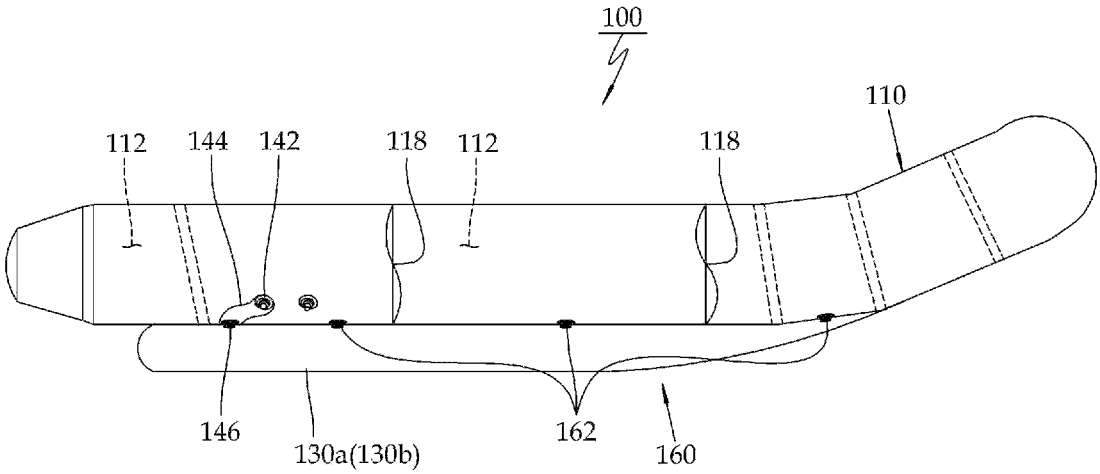
(a)
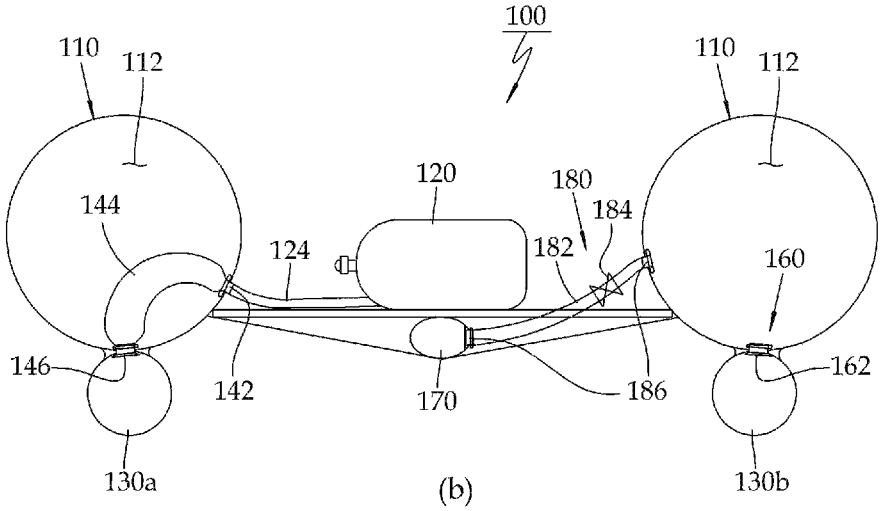
(b)

Fig. 5
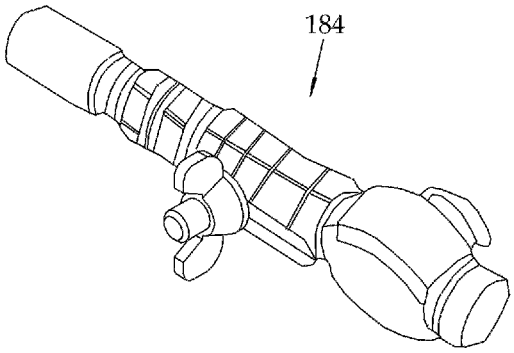
(a)
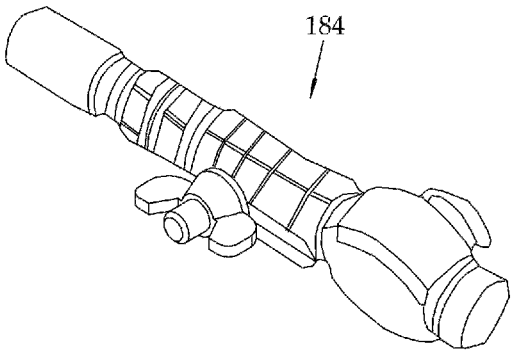
(b)

Fig. 7
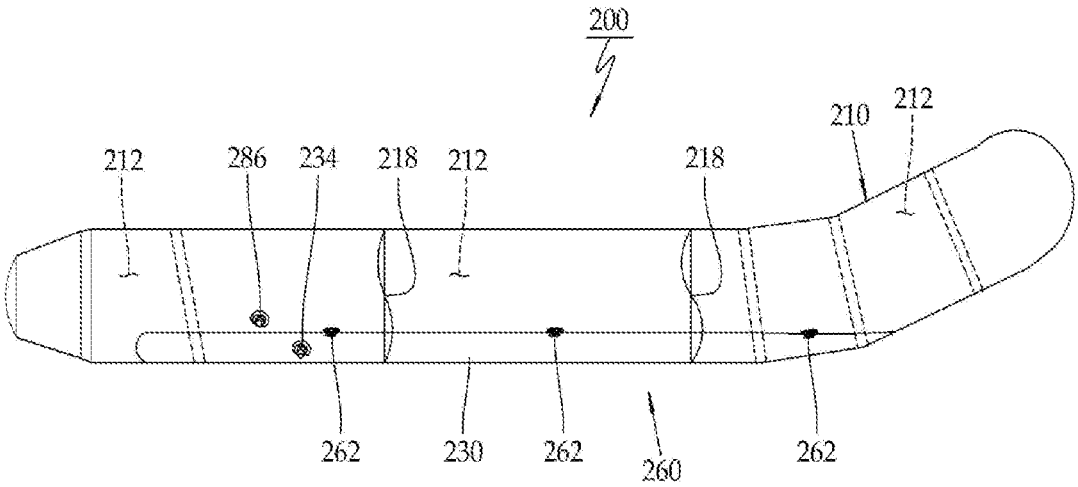
(a)
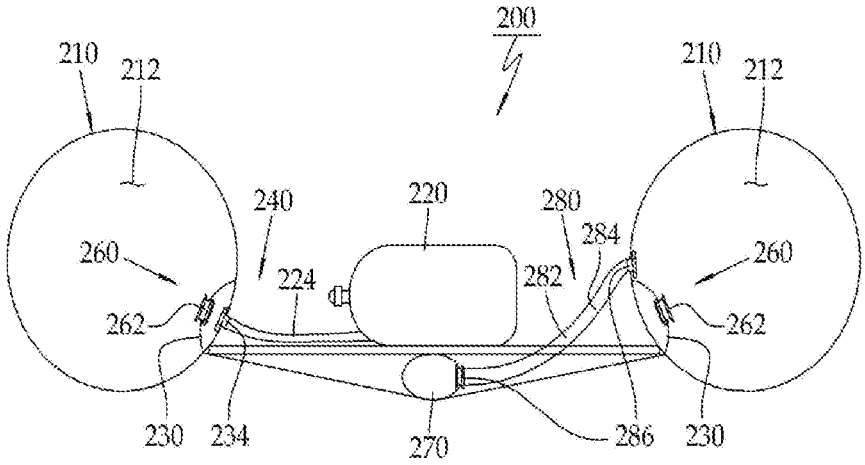
(b)

INFLATABLE BOAT HAVING SELF-INFLATION SYSTEM

CROSS REFERENCE TO RELATED APPLICATION

The application claims priority to Korean Patent Application No. 10-2011-21025 filed on Mar. 9, 2011, the entire contents of which is incorporated by reference herein.

FIELD OF THE INVENTION

The present invention relates to an inflatable boat having a self-inflation system, and more particularly it relates to an inflatable boat having a self-inflation system which advantageously makes it possible to shorten the air injection time, thus quickly taking a proper measure under an emergency situation, in such a manner that a speed tube or an air passage tube disposed in the boat's body and an air distribution system each help inject compressed air into a plurality of compartments forming the boat's body simultaneously at a designated pressure.

BACKGROUND OF THE INVENTION

As shown in FIGS. 1A and 1B, a conventional inflatable boat 1 comprises a boat body 10 formed of a plurality of compartments, a floor 20, a keel 30 and a speed tube 40. The inflatable boat 1 becomes floatable on water with the aid of the compartments 12 filled with air and moves by a driving force generated by a motor or paddle.

In the conventional inflatable boat 1, the air is injected into each compartment 12 in such a manner that an air injection valve V1 and an over pressure relief valve V2 are installed at each compartment 12, thus injecting air into each compartment separately one by one, which is time and energy consuming.

For example, in the conventional inflatable boat 1 each compartment 12 of a tube type body part 10 is equipped with an air injection valve V1 and an over pressure relief valve V2, which consequently leads to causing inconvenience that air should be separately injected into each valve (compartment) one by one.

A self-inflation system for an inflatable boat has been disclosed in an attempt to improve the problems encountered in the above conventional art. The self-inflation system comprises a body part 10, a floor 20, a keel 30 and a plurality of hoses (not shown) and valves each installed at a speed tube 40, thus more efficiently injecting air with the aid of the above elements.

However, the conventional self inflation system for an inflatable boat still has a lot of problems in that air is injected using a plurality of air injection hoses, which results in an overly complicated system with more possible failure points.

So, it is beneficial to develop a new boat having more practical and simple air injection functions, avoiding the complicated structures of the conventional art.

SUMMARY OF THE INVENTION

Accordingly, it is an object of the present invention to provide an inflatable boat having a self-inflation system which advantageously makes it possible to more efficiently inject air into a boat body, a floor, a keel and a speed tube each formed of compartments at a certain pressure level almost simultaneously by using compressed air from a compressed air supply source.

It is another object of the present invention to provide an inflatable boat having a self-inflation system which makes it possible to significantly reduce the amount of time and effort when air is injected into an inflatable boat.

It is further another object of the present invention to provide an inflatable boat having a self-inflation system which makes it possible to more efficiently inject air by connecting an air compressor instead of a compressed air vessel when a compressed air vessel is not available or prepared, and further makes it possible to inject air in a method like in a conventional inflatable boat by using an air injection valve attached to each compartment if necessary.

It is still further another object of the present invention to provide an inflatable boat having a self-inflation system which makes it possible to inject air into a boat in a method of either using a compressed air vessel or not using a compressed air vessel, thus obtaining more versatile possibilities when in use.

To achieve the above objects, there is provided an inflatable boat having a self-inflation system which comprises a tube shaped body part having a plurality of compartments in its interior; a speed tube installed at each of both lower sides of the tube shaped body part; a compressed air supply part which includes a compressed air supply source for generating or storing compressed air, thus supplying the compressed air to the speed tubes, respectively; an air distributor which supplies the air of a designated pressure to each compartment of the body part from the speed tubes; and an air connection part which supplies the air from the body part to the keel at a designated pressure, so the air of the designated pressure can be supplied to each compartment of the body part and the keel from the compressed air supply part via the speed tubes, thus inflating the boat.

To achieve the above objects, there is provided an inflatable boat having a self-inflation system which comprises a tube shaped body part having a plurality of compartments in its interior; an air passage tube which is embedded in a longitudinal direction in both inner sides of the tube shaped body part; a compressed air supply part which includes a compressed air supply source for generating or storing compressed air, thus supplying the compressed air to the air passage tubes, respectively; an air distributor which supplies the air of a designated pressure to each compartment of the body part from the air passage tubes; and an air connection part which supplies the air from the body part to the keel at a designated pressure, so the air of the designated pressure can be supplied to each compartment of the body part and the keel from the compressed air supply part via the air passage tubes, thus inflating the boat.

It is preferred that the compressed air supply part is characterized in that the compressed air supply source is formed of a compressed air vessel or an air compressor, thus supplying the compressed air to each of both sides of the tube shaped body part via the air distributor and the high pressure hose.

In one aspect of the present invention it is not needed to inject air into each compartment one by one by using an air injection valve attached to each compartment. According to the present invention, air can be injected almost simultaneously into each compartment at a desired air pressure via an air distributor which injects high pressure compressed air, thus quickly injecting air at one time under an emergency situation. With the above features, the present invention can be well applied to a rescue boat system which operates all the time under emergency conditions or can be well applied for the purpose of military applications when rapid deployment is required. Even when one compartment of the body part is damaged, the remaining compartments remain safe, thus ensuring the safety of the boat and its passengers.

As another feature of the present invention, first and second over pressure relief valves are additionally attached to each compartment, maintaining a conventional air injection valve attached to each compartment at a designated air pressure. The present invention is directed to a self-inflation system structure which makes it possible to inject air into a plurality of compartments at one time at a designated air pressure since the compressed air from the compressed air supply source is uniformly injected into each compartment via the first and second over pressure relief valves.

According to the present invention, it is possible to allow the designed functions requiring different air pressures in different compartments of an inflatable boat to operate completely since air pressures with different compressed levels can be injected into each compartment by using first and second over pressure relief valves additionally attached to each compartment.

BRIEF DESCRIPTION OF THE DRAWINGS

The present invention will become better understood with reference to the accompanying drawings which are given only by way of illustration and thus are not limitative of the present invention, wherein;

FIG. 1A is a plane view illustrating a conventional inflatable boat;

FIG. 1B is a cross sectional view illustrating a conventional inflatable boat;

FIG. 4A is a side view illustrating an inflatable boat having a self-inflation system according to the present invention;

FIG. 4B is a cross sectional view illustrating an inflatable boat having a self-inflation system according to the present invention;

FIG. 5A is a perspective view illustrating the closed state of a manual opening and closing valve fitted to an inflatable boat having a self-inflation system according to the present invention;

FIG. 5B is a perspective view illustrating the opened state of a manual opening and closing valve fitted to an inflatable boat having a self-inflation system according to the present invention;

FIG. 7A is a side view illustrating another example of an inflatable boat having a self-inflation system according to the present invention; and FIG. 7B is a cross sectional view illustrating another example of an inflatable boat having a self-inflation system according to the present invention.

DETAILED DESCRIPTION OF THE INVENTION

The preferred embodiments of the present invention will be described with reference to the accompanying drawings.

Figure 2:
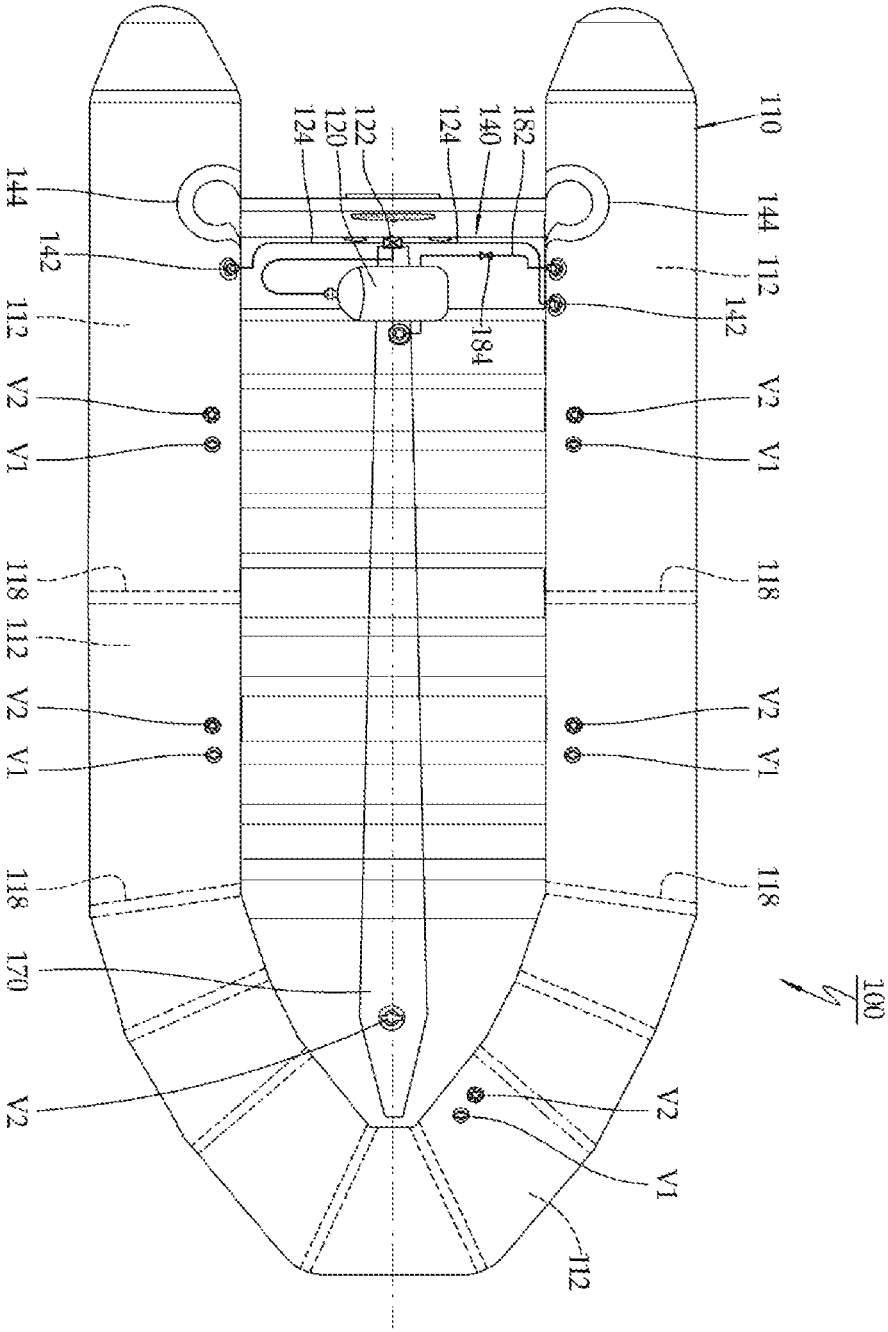
FIG. 2 is a plane view illustrating an inflatable boat having a self-inflation system according to the present invention.
Figure 3:
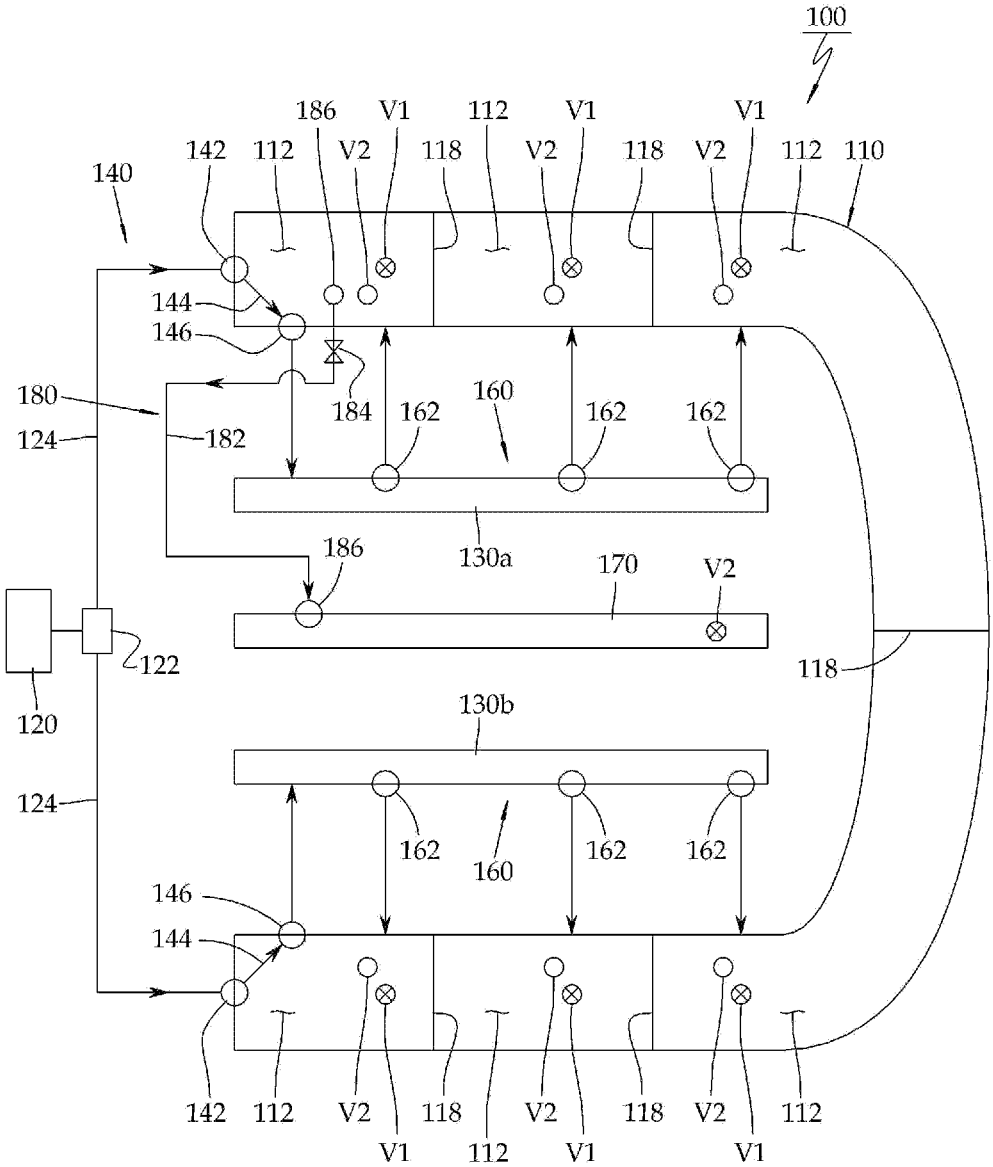
FIG. 3 is a view illustrating an air injection flow of an inflatable boat having a self-inflation system according to the present invention.

As shown in FIGS. 2 to 4, the inflatable boat 100 according to aspects of the present invention comprises an air injection valve V1 attached to each compartment 112 formed in the body part 110, with the air injection valve V1 being the same as a conventional one.

In embodiments of the present invention, a first over pressure relief valve 162 and a second over pressure relief valve V2 are attached to each compartment 112, thus maintaining the air pressure of each compartment 112 at a designated pressure. When the pressure exceeds the designated pressure, the over filled air is automatically discharged to the outside.

In the inflatable boat 100 according to embodiments of the present invention, the compartments 112 are partitioned in the interior of the body part 110 with the aid of the bulkheads 118.

The inflatable boat 100 according to the present invention comprises a compressed air supply source 120 for generating or storing compressed air, and a compressed air supply part 140 for supplying the compressed air to the speed tubes 130*a* and 130*b*, respectively.

As shown in FIGS. 3 and 4B, the compressed air supply part 140 comprises an compressed air vessel corresponding to the compressed air supply source 120 installed at the boat.

The compressed air supply part 140 makes it possible to inject air into each compartment 112 simultaneously by supplying the compressed air via the compressed air supply source 120, one or two high pressure hoses 124, high pressure first and second valves 142 and 146, a high pressure tube 144 and speed tubes 130*a* and 130*b*.

The compressed air supply source 120 of the compressed air supply part 140 is formed of either a compressed air storage vessel or an air compressor, which can be selected by a user.

As shown in FIGS. 3 and 4, the compressed air supply part 140 can supply compressed air into both sides of the tube type body part 110 via the air distributor 122 and the high pressure hose 124 each connected with the compressed air supply source 120.

The compressed air supply part 140 is constituted with one end of the high pressure hose 124 connected with the high pressure first valve 142 which is installed at the compartment 112 of the tube type body part 110, and the high pressure first valve 142 is connected with the high pressure second valve 146 installed at the speed tubes 130*a* and 130*b* via the high pressure tube 144.

The high pressure first valve 142 and the high pressure second valve 146 both are formed of one way valves, thus supplying in only one direction the compressed air from the compressed air supply source 120 to the speed tubes 130*a* and 130*b*.

The compressed air supply part 140 is constituted with one high pressure first valve 142 attached to the compartment 112 positioned at both sides of the body part 110 and the air injection high pressure hose 124 is connected to the high pressure first valve 142.

The high pressure first valve 142 attached to the tube type body part 110 is attached to allow the air to inject only into the speed tubes 130*a* and 130*b* via the high pressure tube 144 separately made and attached in the interior of the body part 110. As shown in FIGS. 4A and 4B, the high pressure tube 144 is connected with the speed tubes 130*a* and 130*b* below the body part 110, respectively.

The speed tubes 130*a* and 130*b* both are attached to the boat for increasing the speed of boat by enhancing buoyancy along with safe cornering. The speed tubes 130*a* and 130*b* are installed at both lower sides of the body part 110 and are formed in the I-shaped tubes each having a diameter smaller than the diameter of the body part 110. The high pressure tube 144 is attached in such a manner that the high pressure first valve 142 is connected to a portion previously formed in the compartment 112 of the body part 110.

The other end of the high pressure tube 144 is attached to the speed tubes 130*a* and 130*b* via the high pressure second valve 146 so that the air injection is directed into the speed tubes 130*a* and 130*b*.

When air is injected with the aid of the first and second valves 142 and 146 and the high pressure tube 144, the air can be injected into only the speed tubes 130*a* and 130*b* attached to the lower side of the body part 110 irrespective of the body part 110.

The inflatable boat 100 according to the present invention further comprises an air distributor 160 for uniformly supplying the air of the designated pressure from the speed tubes 130*a* and 130*b* into each compartment 112 of the body part 110.

The air distributor 160 helps uniformly inject the compressed air simultaneously from the speed tubes 130*a* and 130*b* into the body part 110.

The air distributor 160 comprises a first over pressure relief valve 162 at every connection portion where the speed tubes 130*a* and 130*b* and the body part 110 are connected, namely, at every connection portion being connected to the compartment 112 of the body part 110, thus allowing the air to inject from the speed tubes 130*a* and 130*b* into the body part 110.

In the completed boat, the air is injected using the high pressure hose 124. When the air injected into the speed tubes 130*a* and 130*b* reaches a certain designated pressure level, the first over pressure relief valve 162 is open, and the air is injected into all compartments 112 of the body part 110 simultaneously.

As shown in FIG. 3, the inflatable boat 100 according to the present invention comprises an air connection part 180 for injecting the compressed air from the body part 110 to the keel 170 at a designated pressure.

It is preferred that the air is injected into the keel 170 via the air connection part 180 in such a manner that an air flow passage is formed of a connection hose 182 allowing the air to communicate with the keel 170, thus efficiently injecting the air into the keel 170 via the air connection part 180.

The connection hose 182 is connected with the body part 110 and the keel 170 at both sides via the air injection valve 186. A closing device, namely, a manual opening and closing valve 184, is attached at the connection hose 182. After the air injection into the keel 170 is finished, the user closes the air flow between the body part 110 and the keel 170 by closing the manual opening and closing valve 184.

In the inflatable boat 100 according to the present invention, the compressed air in the compressed air vessel is injected into the air distributor 122 and moves to the high pressure first valve 142 attached to the body part 110 via the high pressure distribution hose 124 connected to the air distributor 122.

The high pressure first valve 142 attached to the body part 110 is attached to the portion closest to the compression air vessel, namely, to the rear compartment 112 of the inflatable boat, according to which the unnecessary length of the high pressure hose 124 can be shortened, thus simplifying the construction.

The high pressure first valve 142 is installed to one end of the high pressure tube 144 which is previously made and attached to an inner side of the body part 110, thus preventing the air from flowing directly into the body part 110.

The high pressure first valve 142 is a one way valve which allows air to inject only in one way. The air injected via the high pressure first valve 142 is supplied to the speed tubes 130*a* and 130*b* via the high pressure tube 144 and the high pressure second valve 146 connected to the other end of the high pressure tube 144.

The speed tubes 130*a* and 130*b* have diameters each being smaller than the diameter of the body part 110. As shown in FIGS. 4A and 4B, the speed tubes 130*a* and 130*b* are equipped with as many of the first over pressure relief valves 162 as the number of the compartments 112 of the body part 110.

The first over pressure relief valve 162 is connected in such a manner that the first over relief valve 162 is installed at every portion of the speed tubes 130*a* and 130*b* corresponding to each compartment 112 between the bulkheads 118 of the body part 110.

The air flow direction of the first over pressure relief valve 162 heads from the speed tubes 130*a* and 130*b* to the compartment 112 of the body part 110, so the air moved to the speed tubes 130*a* and 130*b* can be injected into each compartment 112 of the body part 110 via the first over pressure relief valve 162.

The first over pressure relief valve 162 is a device for preventing the reverse flow of the air. Even if the speed tubes 130*a* and 130*b* are damaged, it is possible to prevent the air of the body part 110 from flowing in a reverse direction and leaking to the outside via the speed tubes 130*a* and 130*b*.

The air injected into the speed tubes 130*a* and 130*b* is injected into each compartment 112 of the body part 110 via the first over pressure relief valve 162 attached to the body part 110, thus maintaining a designated air pressure.

At this time, when the air pressure exceeds about 2.5 bar which is a designated air pressure, only the part of the over pressure is relieved via another second over pressure relief valve V2 installed at each compartment 112 of the body part 110, so only the designated air pressure consequently remains in the compartment 112.

FIG. 4B shows the construction of the left side body part 110 in which the air is introduced into the speed tubes 130*a* and 130*b* via the high pressure tube 144 from the compression tank which functions like the compressed air source 120. In case of the right side body part 110, the air is introduced via the distribution 122 in the same manner as the above. In FIG. 4B, the above construction and operation are omitted for simplification.

The air is inputted into each compartment 112 of the body part 110 via the speed tubes 130*a* and 130*b*, respectively. As shown in FIG. 4B, the air flows into the keel 170 via the air injection valve 186, a one way valve, attached at one side of the body part 110.

As shown in FIGS. 5A and 5B, a manual opening and closing valve 184 is attached at the connection hose 182, with the manual opening and closing valve 184 operating like an opening and closing device for controlling the flow of the air. After the air injection into the keel 170 is finished, the manual opening and closing valve 184 is positioned in the closed position. Since the manual opening and closing valve 184 is closed in the above manner, it is possible to prevent the air flowing into a certain problematic portion connected with the keel 170 from which portion the air might leak, thus obtaining a safe operation.

FIG. 5A is a view illustrating a state that the manual opening and closing valve 184 is closed, and FIG. 5B is view illustrating a state that the manual opening and closing valve 184 is open.

The inflatable boat 100 according to the present invention might be operated to inject the air into each compartment 112 by using the air injection valve V1 attached to each compartment of the body part 110. Alternatively the inflatable boat 100 according to the present invention 100 might be designed to more quickly inject air into each compartment 112 via one or two high pressure tubes 144 and the speed tubes 130*a* and 130*b*, so it is possible to quickly inflate the boat under an emergency situation.

The inflatable boat 100 according to the present invention can be well applied to a rescue boat or a military boat which needs to be inflated extremely quickly. In the present invention, even when at least one compartment among the plurality of the compartment 112 of the body part 110 is damaged, the remaining compartments 112 can operate normally, thus obtaining a safe operation.

According to the present invention, compressed air of high pressure can be quickly injected into each compartment 112 of the body part 110 with the aid of the air distributor 160. In addition, the inflatable boat 100 according to the present invention makes it possible to inject different pressure air into the compartments 112 by using the first and second over pressure relief valves 162, V2 attached to each compartment 112, which results in optimizing the functions of different parts of inflatable boats which require inflation at different air pressures to operate correctly.

The inflatable boat 200 according to another embodiment of the present invention will be described as follows.

Figure 6:
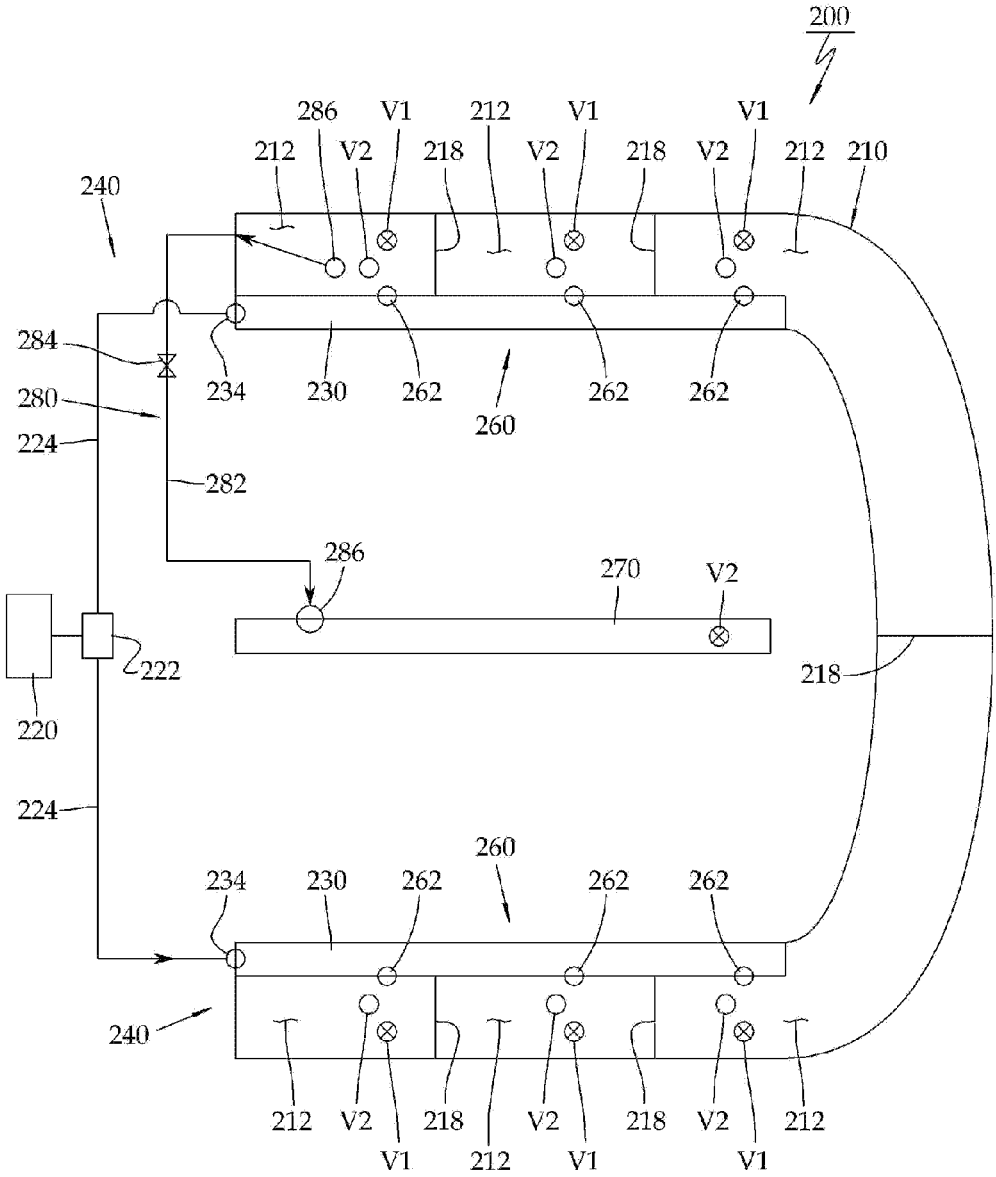
FIG. 6 is a view illustrating an air injection flow of an inflatable boat having a self-inflation system according to another embodiment of the present invention.

The inflatable boat 200 according to the present invention has a known boat structure. FIGS. 6 and 7A and 7B show a method of attaching the air passage tube 230 in the known boat structure without the speed tubes 130*a* and 130*b*. The air passage tube 230 is longitudinally embedded in a small tube shape at an inner lower side of the body part 210 before the compartments 212 are formed using the bulkheads 218 in the course of the manufacture of the body part 210. A plurality of the compartments 212 are formed at an inner side of the body part 210.

According to this other embodiment of the present invention, the inflatable boat is provided with the compressed air supply source 220. There is provided a compressed air supply part 240 supplying the compressed air to the air passage tube 230.

The compressed air supply source 220 of the compressed air supply part 240 is formed of a compressed air vessel or an air compressor, thus supplying the compressed air into both sides of the tube type body part 210 via the air distributor 222 and the high pressure hose 224.

The compressed air supply part 240 is configured in such a manner that the end portion of the high pressure hose 224 is connected to a high pressure third valve 234 of the air passage tube 230 embedded in the tube type body part 210, and the high pressure third valve 234 is formed of one way valve allowing one direction flow of the compressed air heading for the air passage tube 230 from the compressed air supply source 220, thus supplying the compressed air to the air passage tube 230.

The air passage tube 230 is attached to an inner side of the body part 210. In addition, the air passage tube 230 might be attached along the inner side of the body part 210 in a U-shape or might be attached to each of both sides in an I-shape. When the air passage tube 230 is formed in a U-shape, as shown in FIG. 7B, the high pressure hose 224 and the third valve 234 might be connected at only one side, thus injecting compressed air in all of the compartments 112. In case of two I-shapes, it is preferred that the high pressure hose 224 and the third valve 234 are connected with the air passage tube 230 at both the left and right sides so as to obtain stability in the course of injecting air, while balancing left and right sides, thus injecting compressed air simultaneously into the left and right sides.

The inflatable boat 200 according to the present invention is equipped with an air distributor 260 for supplying the air of a designated pressure into each compartment 212 of the body part 210 from the air passage tube 230. The air distributor 260 is formed of a first over pressure relief valve 262 at a portion corresponding to each compartment 212, with the air injection direction of the first over pressure relief valve 262 heading for the inner side of the body part 210 from the air passage tube 230.

When the compressed air is injected into the air passage tube 230 via the third valve 234 of the compressed air supply part 240, the air is first injected into the air passage tube 230 irrespective of the body part 210. When the air passage tube 230 has a certain pressure level, the first over pressure relief valve 262 is opened, and the compressed air of high pressure is simultaneously injected into each compartment 212 of the body part 210.

The air passage tube 230 can include many over pressure relief valves 262 as there are compartments 212 of the body part 210 and they are located at each compartment 212 between the bulkheads 218. The first over pressure relief valve 262 is one way valve in which the flowing direction of the compressed air heads from the air passage tube 230 to the body part 210, according to which the air is injected into each compartment 212 of the body part 210.

The first over pressure relief valve 262 is attached to allow even lower pressure air to flow toward each compartment 212 of the body part 210 via the air passage tube 230. Since the first over pressure relief valve 262 is provided with a device preventing a reverse flow of the air, even if one or more compartment of the compartments 212 of the body part 210 is damaged, the air in the remaining compartments 212 of the body part 210 does not reversely flow via the air passage tube 230.

When the air injected into the air passage tube 230 moves into each compartment 212 of the body part 210 via the first over pressure relief valve 262 attached to the body part 210 and reaches a designated pressure, the air pressure is maintained at about 0.25 bar which is a designated pressure. When the compressed air exceeds the designated pressure, only the excess pressure is relieved via the second over pressure valve V2 attached to each compartment 212 of the body part 210, so the air pressure level consequently remains at a designated pressure.

The air injected into the air passage tube 230 moves into each compartment 212 of the body part 210 via the first over pressure relief valve 262 attached to the body part 210, thus maintaining an air pressure at about 0.25 bar.

The inflatable boat 200 according to the present invention comprises an air connection part 280 which supplies the compressed air from the body part 210 to the keel 270 at a designated pressure.

The air connection part 280 allows the air injected into the body part 210 via the air passage tube 230 to move toward the keel 270 via the air injection valves 286, one way valves, attached at one side of the body part 210 and one side of the Keel 270.

The connection hose 282 of the air connection part 280 comprises an opening and closing device, namely, as shown in FIGS. 5A and 5B, a manual opening and closing valve 184 which controls the flow of air. The user positions the manual opening and closing valve 284 in the closed position after the air injection into the keel 270 is finished. The manual opening and closing valve 284 is positioned in the closed position to prevent the air from moving toward a problematic compartment 212 even if the air leaks due to a problem at the compartment 212 of the body part 210 communicating with the keel 270.

In the inflatable boat 200 according to the present invention, the compressed air might be injected into each compartment 212 by using the air injection valve V1 attached to each compartment 212. Alternatively the inflatable boat 200 according to the present invention might be characterized in that the compressed air can be injected almost simultaneously into each compartment 212 via the high pressure third valve 234, which is installed at one or two positions, the air passage tube 230 installed in the body part 210 and the air distributor 260. Therefore, the inflatable boat 200 according to the present invention can be quickly inflated and used in case of an emergency situation. The inflatable boat 200 according to the present invention can be well applied to a rescue boat, a military purpose or other purposes. Even if one or more compartment among a plurality of compartments 212 is damaged, the remaining compartments 212 remain safe from the damage, thus obtaining the safest operation.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. An inflatable boat, comprising:

a tube shaped body part having a plurality of compartments in an interior of the tube shaped body part;

a speed tube installed at each of both lower sides of the tube shaped body part;

a keel installed on a longitudinal center axis at an outer side of the tube shaped body part;

a compressed air supply part which includes a compressed air supply source for generating or storing compressed air, thus supplying the compressed air to the speed tubes, an air distributor which supplies air to each compartment of the tube shaped body part from the speed tubes; and an air connection part which supplies air from the tubed shaped body part to the keel, wherein air can be supplied to each compartment of the tube shaped body part and the keel from the compressed air supply part via the speed tubes, thus inflating the boat.

2. The inflatable boat according to claim 1, wherein said air distributor comprises a plurality of first over pressure relief valves installed at each compartment to supple compressed air from the speed tubes to each compartment of the tube shaped body part.

3. The inflatable boat according to claim 1, wherein said air connection part comprises a connection hose connected from the tube shaped body part to the keel for supplying air from the tube shaped body part to the keel.

4. An inflatable boat, comprising:

a tube shaped body part having a plurality of compartments in an interior of the tube shaped body part;

a keel installed on a longitudinal center axis at an outer side of the tube shaped body part;

an air passage tube which is embedded in a longitudinal direction in both inner sides of the tube shaped body part;

a compressed air supply part which includes a compressed air supply source for generating or storing compressed air, thus supplying the compressed air to the air passage tubes, respectively;

an air distributor which supplies air to each compartment of the tube shaped body part from the air passage tubes; and an air connection part which supplies air from the tube shaped body part to the keel, wherein air can be supplied to each compartment of the tube shaped body part and the keel from the compressed air supply part via the air passage tubes, thus inflating the boat.

5. The inflatable boat according to claim 4, wherein said air distributor comprises a plurality of first over pressure relief valves installed at each compartment to supply compressed air from the air supply passages to each compartment of the tube shaped body part.

6. The inflatable boat according to claim 4, wherein said air connection part comprises a connection hose connected from the tube shaped body part to the keel for supplying air from the tube shaped body part to the keel.

7. The inflatable boat according to claim 4, wherein said air passage tube is formed in a U-shape along an inner side of the tube shaped body part, or is formed in an I-shape at each of both sides.

* * * * *

UNITED STATES PATENT AND TRADEMARK OFFICE

CERTIFICATE OF CORRECTION

PATENT NO. : 8,522,708 B2
APPLICATION NO. : 13/109097
DATED : September 3, 2013
INVENTOR(S) : Dong-Gyu Chon It is certified that error appears in the above-identified patent and that said Letters Patent is hereby corrected as shown below:

In the Claims

Column 10, Claim 2, Line 3; delete “supple” and replace with “supply”.

Signed and Sealed this
Thirty-first Day of December, 2013

Margaret A. Focarino

Margaret A. Focarino
*Commissioner for Patents of the United States Patent and Trademark Office*